US007744251B2

(12) United States Patent
Liu et al.

(10) Patent No.: US 7,744,251 B2
(45) Date of Patent: Jun. 29, 2010

(54) LED LAMP HAVING A SEALED STRUCTURE

(75) Inventors: You-Xue Liu, Shenzhen (CN); Li He, Shenzhen (CN); Tsung-Lung Lee, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 189 days.

(21) Appl. No.: 12/101,137

(22) Filed: Apr. 10, 2008

(65) Prior Publication Data

US 2009/0257226 A1 Oct. 15, 2009

(51) Int. Cl.
*F21V 29/00* (2006.01)

(52) U.S. Cl. ..... 362/294; 362/373; 362/249.02; 362/311.02; 362/311.14; 362/363

(58) Field of Classification Search ..... 362/235, 362/244, 249.02, 294, 311.01, 311.02, 311.14, 362/363, 373, 800
See application file for complete search history.

(56) References Cited

U.S. PATENT DOCUMENTS 2,016,722 A * 10/1935 Levin ..... 362/280
3,961,174 A * 6/1976 Blaylock ..... 362/317
4,703,403 A * 10/1987 Smith et al. ..... 362/268
7,195,058 B2 * 3/2007 Wolford et al. ..... 165/104.21
7,513,653 B1 * 4/2009 Liu et al. ..... 362/294
7,568,817 B2 * 8/2009 Lee et al. ..... 362/294
7,607,803 B2 * 10/2009 Zhang et al. ..... 362/294
2002/0122309 A1 * 9/2002 Abdelhafez et al. ..... 362/294
2007/0159828 A1 * 7/2007 Wang ..... 362/294
2008/0130299 A1 * 6/2008 Dorogi ..... 362/373
2008/0316755 A1 * 12/2008 Zheng et al. ..... 362/373
2009/0016062 A1 * 1/2009 Lee et al. ..... 362/294
2009/0097241 A1 * 4/2009 Xu et al. ..... 362/234
2009/0213592 A1 * 8/2009 Zhang et al. ..... 362/249.02

* cited by examiner

*Primary Examiner*—Ismael Negron
(74) *Attorney, Agent, or Firm*—Frank R. Niranjan

(57) ABSTRACT

An LED lamp includes a lamp holder, a heat sink, a plurality of LED modules, a cover, an envelope and a sealing cushion. The lamp holder has a connecting portion at a bottom thereof adapted for engaging with a lamp socket to fix the LED lamp in position. The heat sink is disposed on the lamp holder. The LED modules are attached to a circumference of the heat sink. The cover is coupled to a top of the heat sink. The envelope encloses the heat sink and the LED modules therein and has a lower end engaging with the lamp holder and an upper end engaging with the cover. The sealing cushion is provided between at least one of the combinations of the lamp holder and the envelope, and of the cover and the envelope to prevent an entry of foreign matter.

13 Claims, 5 Drawing Sheets

LED LAMP HAVING A SEALED STRUCTURE

BACKGROUND OF THE INVENTION

1. Field of the Invention

The present invention relates to an LED lamp, and more particularly to an improved LED lamp having a sealed structure to prevent an entry of mist, dust, rainwater and other foreign matter into the LED lamp.

2. Description of Related Art

An LED lamp is a type of solid-state lighting that utilizes light-emitting diodes (LEDs) as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

When the LED lamp is used in the outdoors for illumination, mist, dust, rainwater or other foreign matter is prone to creep into the LED lamp, which may cause electric leakage or short circuit of the LED lamp, or a contamination of the LEDs used in the LED lamp.

What is needed, therefore, is an improved LED lamp which has a simple and novel structure, whereby the LED lamp is suitable to mass-manufacture and has an improved waterproof configuration for preventing rainwater, dust, etc. from creeping into the LED lamp.

SUMMARY OF THE INVENTION

An LED lamp includes a lamp holder, a heat sink, a plurality of LED modules, a cover, an envelope and a sealing cushion. The lamp holder has a connecting portion at a bottom thereof adapted for engaging with supporting rod to fix the LED lamp in position. The heat sink is disposed on the lamp holder. The LED modules are attached to a circumference of the heat sink. The cover is coupled to a top of the heat sink and thermally connects therewith so heat of the heat sink can be dissipated to surrounding air of the LED lamp through the cover. The envelope encloses the heat sink and the LED modules therein and has a lower end engaging with the lamp holder and an upper end engaging with the cover. The sealing cushion is provided in at least one of the combinations of the lamp holder and the envelope, and of the cover and the envelope to prevent an entry of foreign matter into the LED lamp.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
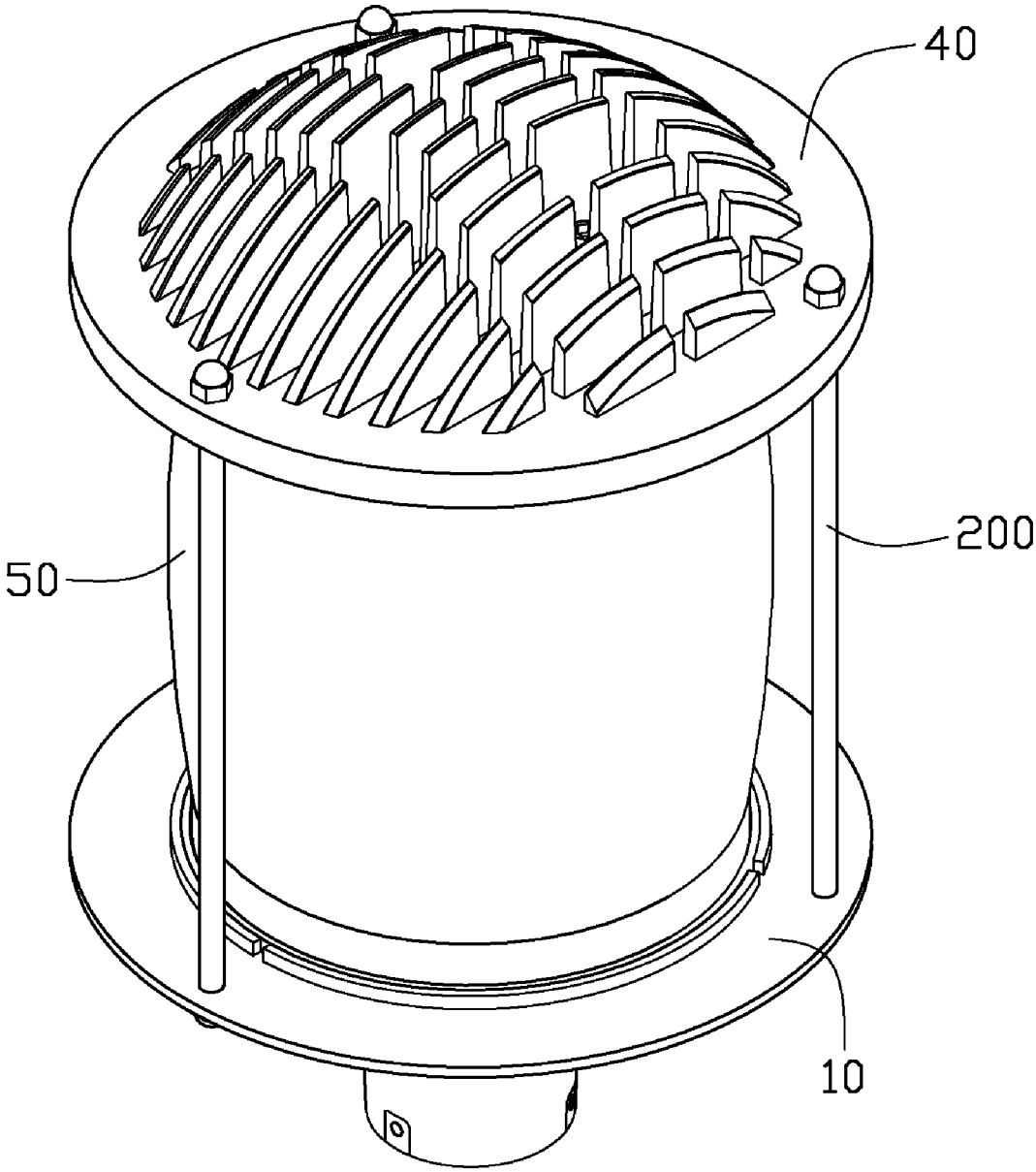
FIG. 1 is an isometric, assembled view of an LED lamp in accordance with a preferred embodiment of the present invention.
Figure 2:
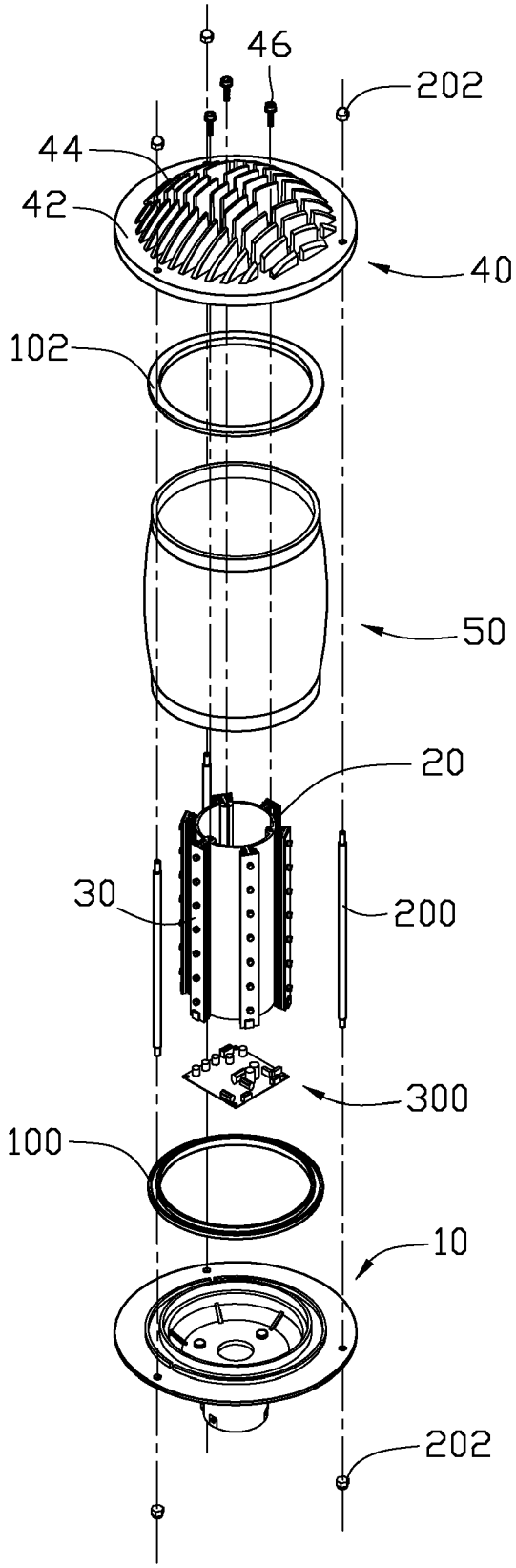
FIG. 2 is an exploded view of FIG. 1.
Figure 3:
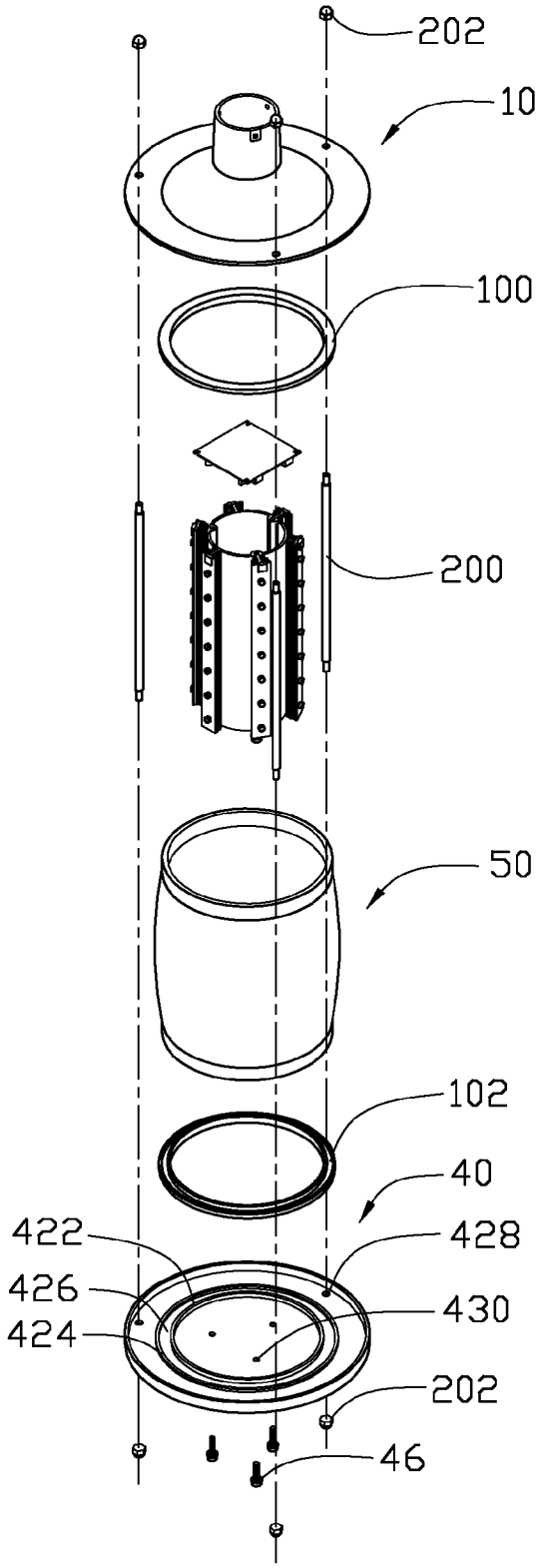
FIG. 3 is an inverted view of FIG. 2.

Referring to FIGS. 1-3, an LED lamp in accordance with a preferred embodiment is illustrated. The LED lamp comprises a lamp holder 10, a heat sink 20 mounted on the lamp holder 10, a plurality of LED modules 30 attached to the heat sink 20, a cover 40 covered on a top of the heat sink 20, and an envelope 50 located between the lamp holder 10 and the cover 40 and enclosing the heat sink 20 and the LED modules 30 therein. Three connecting shafts 200 are mounted around the envelope 50 and stand between the lamp holder 10 and the cover 40. The LED lamp is further provided with a first annular cushion 100 sandwiched between the envelope 50 and the lamp holder 10, and a second annular cushion 102 sandwiched between the envelope 50 and the cover 40 to prevent an entry of foreign matter such as mist, dust and rainwater from entering the LED lamp to cause the LED lamp to have an electric leakage or short circuit or to cause the LED modules 30 to be contaminated.

Figure 4:
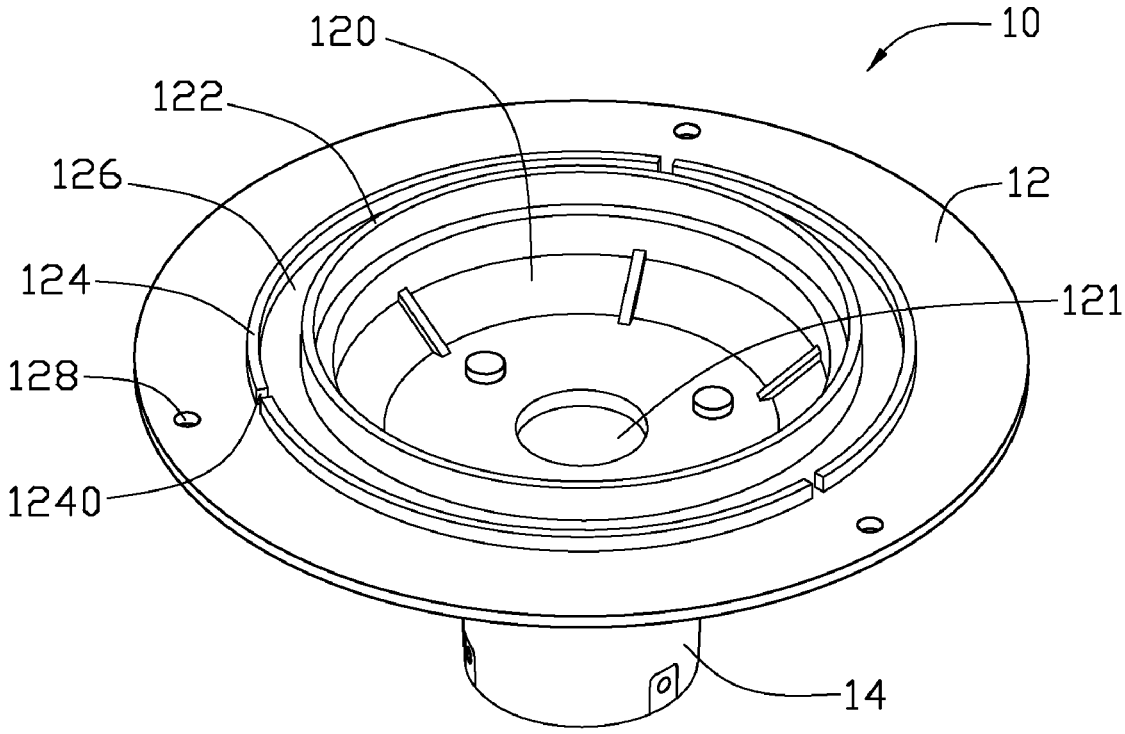
FIG. 4 shows a lamp holder of the LED lamp of FIG. 2.

As expressly shown in FIG. 4, the lamp holder 10 comprises a discal base 12 and a connecting portion 14 extends downwardly from a central portion of a bottom of the base 12 for securing the LED lamp onto a supporting structure (not shown) such as a supporting rod. The base 12 has a bowl-shaped receiving chamber 120 downwardly recessing from a central portion thereof, for receiving a driving circuit module 300 therein. A through bore 121 is defined in a centre of a bottom of the receiving chamber 120 for an extension of lead wires into the LED lamp. The base 10 has an annular inner flange 122 extending upwardly from the top thereof and surrounding the receiving chamber 120 and an annular outer flange 124 concentric with the inner flange 122 and protruding upwardly from a top thereof. The inner flange 122 is preferred to have a height larger than that of the outer flange 124. The inner and outer flanges 122, 124 are spaced from each other, thereby defining a first groove 126 therebetween for receiving a bottom end of the envelope 50. Three cutouts 1240 are equidistantly defined in the outer flange 122 for facilitating an outflow of rainwater accidentally infiltrated into the first groove 126. Three first securing holes 128 are evenly defined in the base 12 and surround the outer flange 124, for respectively receiving three lower ends of the connecting shafts 200.

Figure 5:
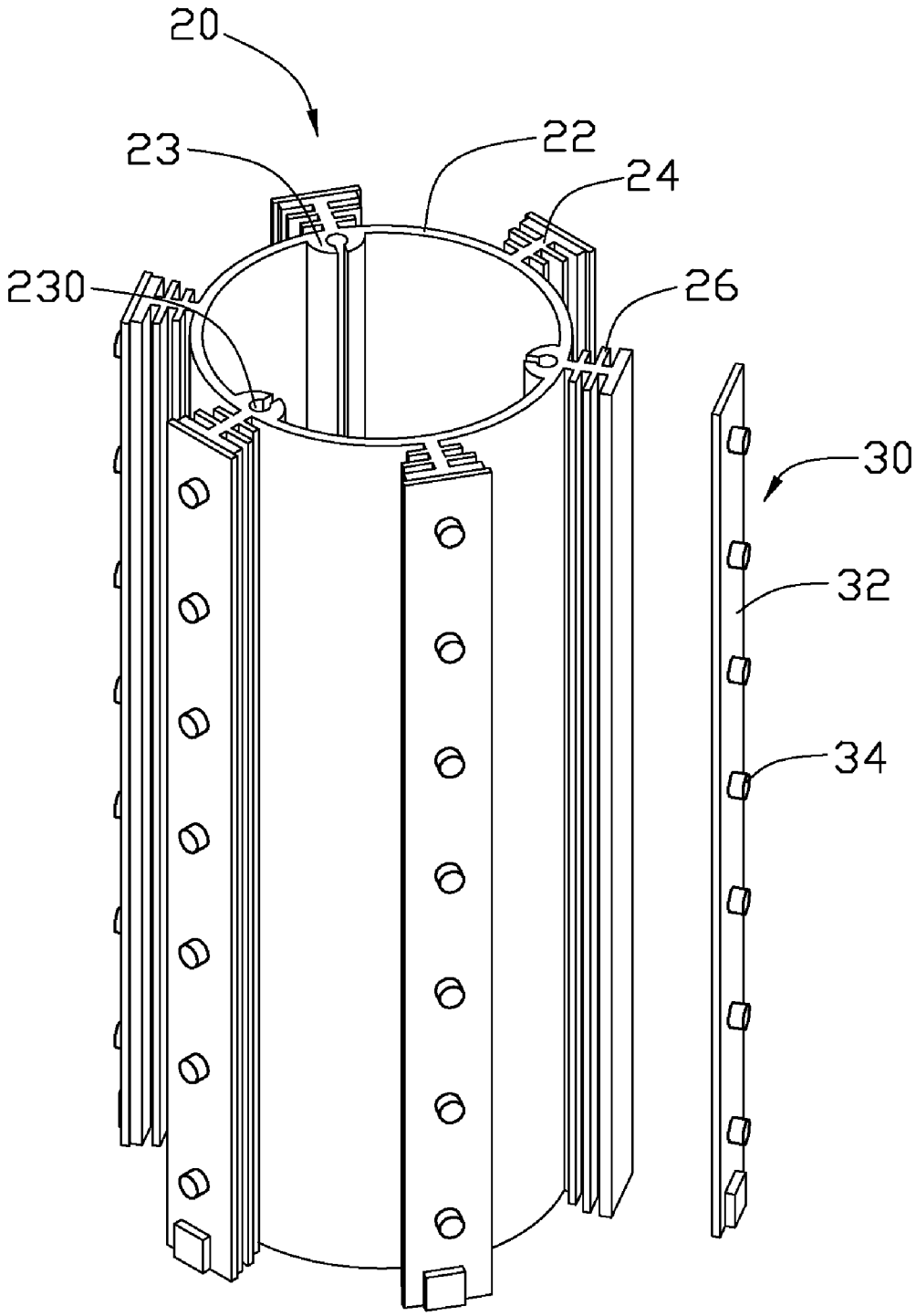
FIG. 5 shows a heat sink of the LED lamp of FIG. 2.

As shown in FIG. 5, the heat sink 20 is integrally made of a metal with a good heat conductivity, such as aluminum, copper or an alloy thereof. The heat sink 20 has an elongated cylinder 22 with a through hole (not labeled) defined therein. The heat sink 20 has a plurality of conducting arms 24 evenly extending outwardly from a circumferential surface of the cylinder 22. The conducting arms 24 are identical and centrosymmetric to each other relative to an axis of the cylinder 22. The conducting arms 24 have a number which is consistent with that of the LED modules 30 in the preferred embodiment, and can be different in different embodiments. In this embodiment, the numbers of the conducting arms 24 and the LED modules 30 are both six. A plural pairs of first fins 26 are formed on two opposite lateral sides of each of the conducting arms 24. Each pair of the first fins 26 extend outwardly and perpendicularly from two lateral sides of a corresponding conducting arm 24 and are symmetrical to each other relative to the corresponding conducting arm 24. The first fins 26 at a lateral side of each of the conducting arms 24 increase in length outwardly from the cylinder 22 to a distal end of the corresponding conducting arm 24. Each of the conducting arms 24 has a distal end terminating at an inside face of an outmost first fin 26 thereof. An outside face (not labeled) of each outmost first fin 26 is flat and used for thermally contacting with one of the LED modules 30, when the LED module 30 is mounted on the outside face. Three elongated ridges 23 extend inwardly from an interior surface of the cylinder 22 of the heat sink 20 and are evenly distributed at the cylinder 22. Each of the ridges 23 therein defines a vertical mounting orifice 230.

Referring to FIGS. 2 and 3 again, the LED modules 30 are respectively attached to the outer faces of the fins 26 of the heat sink 20, and each comprises an elongated printed circuit board 32 with a size corresponding to that of the outmost first fin 26 of the heat sink 20 and a plurality of LED components 34 which are mounted on the printed circuit board 32 and arranged in a line along a length of the printed circuit board 32.

The cover 40 is secured on the top of the heat sink 20 and comprises a circular plate 42 and a plurality of second fins 44 arranged on the plate 42. Corresponding to the mounting orifices 230 in the ridges 23 of the heat sink 20, three through orifices 430 are defined in the plate 42. Three screws 46 are brought to extend through the through orifices 430 to engage into the mounting orifices 230 to thereby fix the cover 40 to the top of the heat sink 20. An annular inner protrusion 422 and an annular outer protrusion 424 concentric with the inner protrusion 422 extend downwardly from a bottom surface of the plate 42. The inner protrusion 422 and the outer protrusion 424 are spaced from each other, thereby defining a second groove 426 therebetween. The second groove 426 is in alignment with the first groove 126 of the lamp holder 10 and engagingly receives an upper end of the envelope 50. The second fins 44 are parallel to each other and extend perpendicularly from a top surface of the plate 42. A plurality of spaced channels (not labeled) is defined in the second fins 44 for facilitating airflow taking heat away from the second fins 44 into ambient air. Corresponding to the first securing holes 128 in the base 12 of the lamp holder 10, three second securing holes 428 are defined in the plate 42 for receiving upper ends of the connecting shafts 200.

The envelope 50 has a tubular shape with a through hole (not labeled) defined therein. A diameter of the envelope 50 decreases gradually from a middle toward two opposite ends of the envelope 50. The two opposite ends of the envelope 50 each have a shape substantially similar to that of a corresponding one of the first and second grooves 126, 426. The envelope 50 is made of a transparent or semitransparent material such as glass, plastic, etc., for allowing the light emitted by the LED module 30 traveling therethrough to illuminate a surrounding environment.

The first and second cushions 100, 102 respectively have configurations which are similar to those of the first and second grooves 126, 426, respectively. The first and second cushions 100, 102 are received fitly in the first and second grooves 126, 426, respectively. The first and second cushions 100, 102 respectively define recesses (not labeled) at top and bottom surfaces thereof facing the lower and upper ends of the envelope 50, respectively. The lower and upper ends of the envelope 50 are interferingly fixed into the recesses of the first and second cushions 100, 102.

Each of the connecting shafts 200 has a shape of an elongated post and forms screw thread on two opposite ends thereof for respectively engaging with two nuts 202.

In assembly, the driving circuit module 300 is placed in the receiving chamber 120 of the lamp holder 10. The heat sink 20 has a lower end snugly received in the receiving chamber 120 of the lamp holder 10 and enclosing the driving circuit module 300 therein. The LED modules 30 are respectively attached to the outer faces of the first fins 26 of the heat sink 20 in a thermal conductive relationship. The envelope 50 encloses the heat sink 20 assembled with the LED modules 30. The cover 40 then is coupled onto the heat sink 20 and the envelope 50. The first and second cushions 100, 102 are respectively received in the first and second grooves 126, 426. The first cushion 100 is sandwiched between the envelope 50 and the lamp holder 10; the second cushion 102 is sandwiched between the envelope 50 and the cover 40. Two opposite ends of each of the connecting shafts 200 respectively extend through the first and second securing holes 128,428 and respectively engage with two nuts 202 to securely connect the lamp holder 10 and the cover 40.

In operation, heat generated by the LED modules 30 is conducted to the heat sink 20 and then reaches the cover 40 via the heat sink 20. The heat is finally dissipated into ambient through the second fins 44 of the cover 40. The first and second cushions 100, 102 are respectively in the first groove 126 of the lamp holder 10 and the second groove 426 of the cover 40. The upper and lower ends of the envelope 50 tightly engaged into the recesses of the first and second cushions 100, 102, thereby enhancing waterproof function of the LED lamp. Furthermore, by locking the nuts 202 with the connecting shafts 200 as tightly as possible, wherein the nuts 202 are respectively located above the cover 40 and below the lamp holder 10, the lamp holder 10 and the cover 40 can be forced to move toward each other, thereby further reinforcing the hermetic connection between the envelope 50 and the cover 40 and between the envelope 50 and the lamp holder 10.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:

a lamp holder having a connecting portion at a bottom thereof, adapted for engaging with a supporting rod to fix the LED lamp in position;

a heat sink disposed on the lamp holder;

a plurality of LED modules attached to a circumference of the heat sink;

a cover coupled to a top of the heat sink, in which heat absorbed by the heat sink from the LED modules is transferred to the cover to be dissipated to surrounding air;

an envelope enclosing the heat sink and the LED modules therein and having a lower end engaging with the lamp holder and an upper end engaging with the cover; and at least a sealing cushion provided in at least one of the combinations of the lamp holder and the envelope, and of the cover and the envelope to prevent an entry of foreign matter into the LED lamp;

wherein the heat sink comprises a cylinder, a plurality of conducting arms extending outwardly from an outer sidewall of the cylinder, and a plurality of first fins are formed on two opposite lateral sides of each of the conducting arms.

2. The LED lamp as claimed in claim 1, wherein a plurality of connecting shafts extends through and connects the lamp holder and the cover.

3. The LED lamp as claimed in claim 1, wherein a diameter of the envelope decreases gradually from a middle toward two opposite ends of the envelope.

4. The LED lamp as claimed in claim 1, wherein the envelope is made of a transparent or semitransparent material.

5. The LED lamp as claimed in claim 1, wherein the LED modules are mounted on the first fins of the heat sink, each of the LED modules comprising a printed circuit board and a plurality of LEDs mounted on the printed circuit board.

6. The LED lamp as claimed in claim 1, wherein a plurality of second fins are formed on a top surface of the cover, the second fins are parallel to each other and extend perpendicularly from the top surface of the cover.

7. The LED lamp as claimed in claim 1, wherein the lamp holder defines a first groove in a top thereof, the at least a sealing cushion including a first sealing cushion received in the first groove.

8. The LED lamp as claimed in claim 7, wherein an annular inner flange and an annular outer flange extend upwardly from a top of the lamp holder to define the first groove.

9. The LED lamp as claimed in claim 8, wherein the inner flange have a height larger than that of the outer flange, and a plurality of cutouts is defined in the outer flange to facilitate an outflow of rainwater from the first groove.

10. The LED lamp as claimed in claim 7, wherein the cover in a bottom thereof defines a second groove corresponding to the first groove, the at least a sealing cushion including a second sealing cushion received in the second groove.

11. The LED lamp as claimed in claim 10, wherein the first and second sealing cushions define recesses facing lower and upper ends of the envelope, respectively, the lower and upper ends of the envelope respectively engaged into the recesses of the first and second sealing cushions.

12. The LED lamp as claimed in claim 10, wherein an annular inner protrusion and an annular outer protrusion concentric with the inner protrusion both extend downwardly from a bottom surface of the cover to define the second groove therebetween.

13. An LED lamp comprising:

a heat sink having a cylinder, a plurality of connecting arms extending outwardly from the cylinder and a plurality of fins extending from each of the arms;

a plurality LED modules each mounted on an outer surface of an outermost one of the plurality of fins;

a lamp holder secured to a bottom of the heat sink adapted for connecting with a supporting rod for fixing the LED lamp in position, the lamp holder having an annular inner flange and an annular outer flange and a groove between the inner and outer flanges, the outer flange defining a plurality of cutouts therein adapted for facilitating flowing out of water in the groove;

a waterproof cushion received in the groove;

an envelope surrounding the heat sink and the LED modules, having a bottom end fitted into the groove;

a cover mounted to top ends of the heat sink and the envelope, wherein the cover is thermally connected with the heat sink and heat absorbed by the heat sink from the LED modules is dissipated to surrounding air of the LED lamp through the cover.

* * * * *